United States Patent [19]

Heffner et al.

[11] Patent Number: 5,038,827

[45] Date of Patent: Aug. 13, 1991

[54] SHUTTLE VALVE FOR A REFRIGERATION SYSTEM

[75] Inventors: Joseph H. Heffner, Chesterfield; Dennis L. Hoehne, St. Louis, both of Mo.

[73] Assignee: Sporlan Valve Company, St. Louis, Mo.

[21] Appl. No.: 603,569

[22] Filed: Oct. 25, 1990

[51] Int. Cl.[5] ..... F16K 11/048

[52] U.S. Cl. ..... 137/627; 137/869; 137/607; 137/625.33

[58] Field of Search ..... 137/627, 607, 596.16, 137/596.18, 625.33, 869

[56] References Cited

U.S. PATENT DOCUMENTS

| | | | |
|---|---|---|---|
| 3,480,041 | 11/1969 | Whitlock | 137/625.29 X |
| 3,867,960 | 2/1975 | Hosoda et al. | 137/625.29 X |
| 4,754,693 | 7/1988 | Teltscher | 137/596.18 X |

*Primary Examiner*—Arnold Rosenthal
*Attorney, Agent, or Firm*—Ronald W. Hind

[57] ABSTRACT

A shuttle valve (10) for use in a dual refrigerator system (100) and operated by controlled refrigerant pressure lines (120, 122) to provide that either one or both of two evaporators (104, 106) are active. The valve (10) includes piston chambers (30) at each end having an outer portion (26) communicating with pressure lines (120, 122) and an enlarged inner portion (32) and an intermediate chamber (21) having valve seats (22) at each end. The valve (10) includes inlet and outlet ports (14, 16) communicating with the piston chamber enlarged portions (32) and an outlet part (18) communicating with the intermediate chamber (21). The valve (10) also includes a piston assembly (40) having opposed pistons (41, 42) interconnected by a biased push rod (44) and mounted in associated piston chambers for closing associated inlet ports (104, 106). Each piston includes an inner portion (48) having a first seal (54) engageable with a valve seat (22) and movable within the piston chamber enlarged portion (32) and an outer portion (46) having a second seal (58) received within the piston chamber inner portion (26).

10 Claims, 1 Drawing Sheet

SHUTTLE VALVE FOR A REFRIGERATION SYSTEM

BACKGROUND OF THE DISCLOSURE

This invention relates generally to shuttle valves and more particularly to a shuttle valve for use in a refrigeration system.

Shuttle valves of the type under consideration are known in the prior art. These valves are provided with pistons which close the entry ports and utilize a seal of such as an O-ring, or a synthetic sliding seal which crosses the ports. This arrangement has the disadvantage of damaging the piston seals by rubbing them against the margins of the entry ports. Alternatively, a precision metal-to-metal fit is used. With this arrangement also, the pistons are forced to slide across the entry ports to open and close the flow passages, with the disadvantage that high seat leakage is frequently experienced.

Another disadvantage of previous shuttle valves of this type is that a heavy spring is used between the pistons to urge them apart and ensure that both entry ports are never closed at the same time. The spring has to be sufficiently strong to overcome the pressure differential across the closed port. Unfortunately, using a heavily loaded spring between the pistons tends to cause misalignment of the pistons thereby aggravating the damage potential to the seals sliding across the entry ports. In addition, the use of a large spring between the pistons, because of the space taken up by the spring restricts flow through the inlet and outlet ports since flow to the common port is through the spring chamber.

The present shuttle valve solves these and other problems in a manner not revealed in the known prior art.

SUMMARY OF THE INVENTION

This shuttle valve provides a means for controlling flow of refrigerant in a multi-evaporator system from the evaporator units to the condensing unit.

This invention provides a shuttle valve with an improved sealing system for the piston assembly which is arranged, at least in part, within an enlarged piston chamber to avoid damage to the seal as the piston closes the entry ports. The invention also eliminates the need for a heavy spring between the pistons thereby avoiding misalignment of the pistons, which results from heavy spring load acting on the pistons, and provides a relatively small diameter biased push rod connection between the pistons, which minimizes the restriction of flow between the inlet and outlet ports and also provides a guide further reducing wear and seal damage. Further, the use of a push rod of a predetermined length prevents closure of both ports at the same time.

This shuttle valve, for use in a dual refrigeration system and operated by controlled refrigerant pressure lines in the system, includes a valve body including piston chambers at each end having an outer portion communicating with an associated controlled pressure line and an enlarged inner portion, and an intermediate chamber disposed between said piston chambers and having valve seats at each end, and said valve body further including at least two inlet ports each communicating with an associated piston chamber inner portion and an outlet port communicating with said intermediate chamber; the valve also includes a piston assembly having opposed pistons each mounted in an associated piston chamber for selectively closing an associated inlet port, in response to differential pressure in the pressure lines, each piston having an outer portion received in sliding relation within said piston chamber outer portion and an inner portion, said inner portion including first sealing means received within an associated valve seat and movable within said piston chamber enlarged inner portion and said outer portion including second sealing means engageable with an associated piston chamber outer portion, and means tending to urge said pistons away from each other.

It is an aspect of this invention to provide that each piston includes a passage having a closed end and the piston assembly further includes a push rod having opposed ends each received in sliding relation within an associated piston passage.

It is another aspect of this invention to provide that the means tending to urge said pistons away from each other include compression spring means mounted on said push rod.

It is still another aspect of this invention to provide that opposed end caps are threadedly connected to each end of said body portion, each end cap defining a piston chamber outer portion, and including a restricted orifice communicating with said associated pressure lines.

It is yet another aspect of this invention to provide that each piston includes inner and outer portions and means operatively threadedly connecting said piston outer and inner portions together.

Another aspect of this invention is to provide that the first sealing means is a washer seal connected to said inner portion of said piston by said connecting means.

Still another aspect of this invention is to provide that the second sealing means is a cup seal connected between said inner and outer portions of said piston by said connecting means.

Yet another aspect of this invention is to provide that each piston connecting means connecting said inner and outer portions together, includes an axial bolt bored to provide the passage receiving an end of said push rod therewithin, and to provide that said compression spring means is operatively mounted on said push rod.

It is another aspect of this invention to provide that opposed end caps are threadedly connected to each end of said body, each end cap defining a piston chamber outer portion having an end margin, and each piston inner portion includes a flange engageable with an associated end cap end margin, said engagement limiting outward movement of said associated piston.

It is still another aspect of this invention to provide that the push rod is of a length to ensure that both inlets are not closed at the same time.

It is yet another aspect of this invention to provide that each inlet is connected to its associated pressure line by a bleed line.

It is an aspect of this invention to provide a shuttle valve which is relatively inexpensive and simple to manufacture and which maintains full port flow while minimizing the overall size and weight of the valve.

DESCRIPTION OF THE PREFERRED EMBODIMENT

Figures 1, 2:
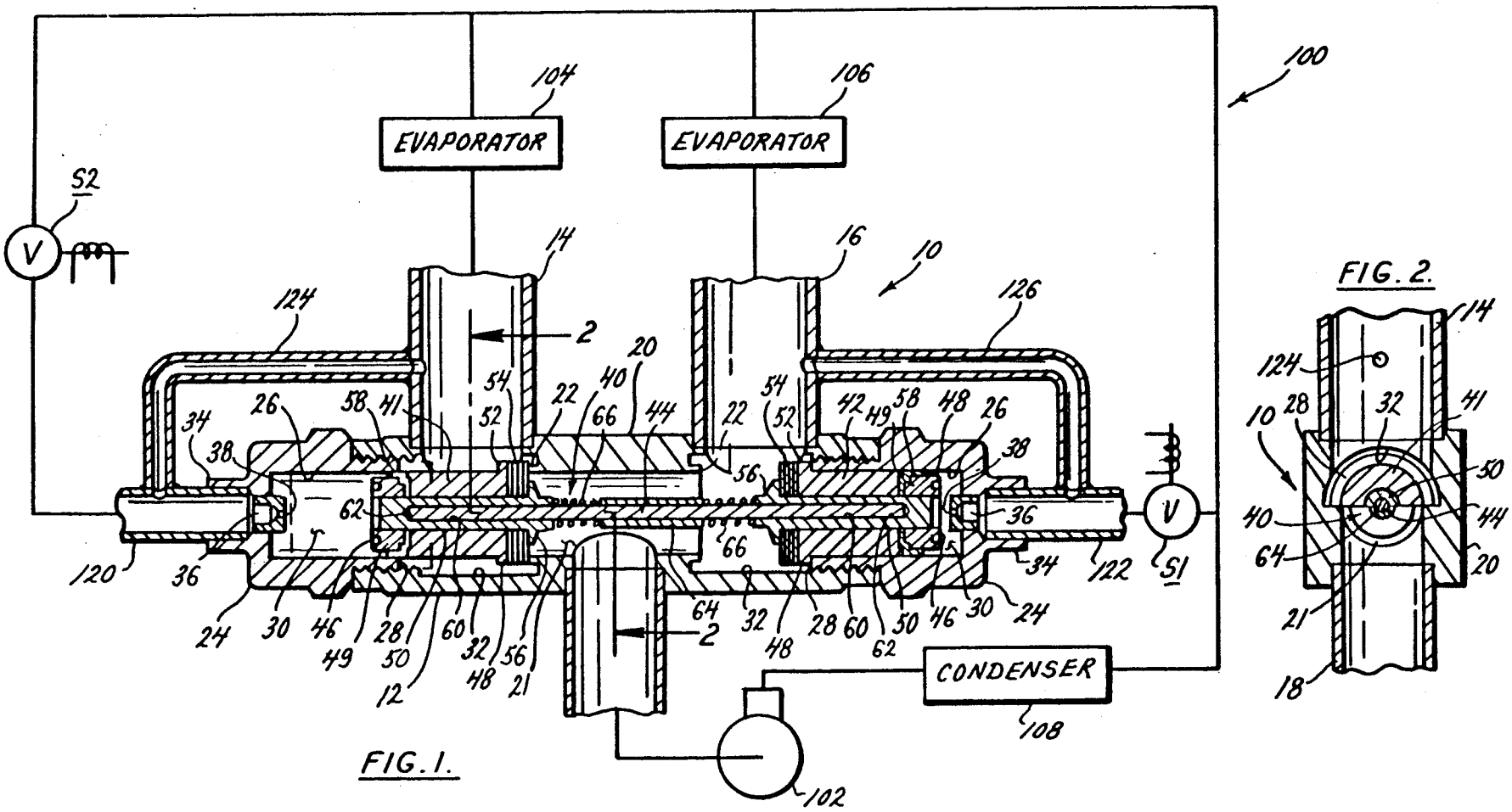
FIG. 1 is a longitudinal cross section through the shuttle valve in a dual evaporator refrigerator system.
FIG. 2 is a cross-sectional view taken on line 2—2 of FIG. 1.

Referring now by reference numerals to the drawing, it will be understood that the shuttle valve 10 can be used in a dual air conditioning or refrigeration system generally indicated by numeral 100. This system includes a compressor 102, two evaporators 104 and 106 and a condensing unit 108. Programmable solenoid control valves S1 and S2 are used to control the disposition of the shuttle valve 10 such that either evaporator 104 is active or evaporator 106 is active or both evaporators 104 and 106 are active.

The shuttle valve 10 includes a body 12 having fittings 14 and 16, providing inlet ports, and fitting 18 providing an outlet port, said fittings being attached thereto as by welding. Inlet fittings 14 and 16 communicate with evaporators 104 and 106 respectively and outlet fitting 18 communicates with the suction side of the compressor 102 and condensing unit 108. The intermediate portion 20 of the body 12 provides an intermediate chamber 21 and piston chambers 30 are provided at each end. The intermediate body portion 20 is grooved to define annular valve seats 22 and the ends of the body are internally threaded to receive opposed end caps 24 having passages 26 and annular end margins 28, said caps in effect, providing ends for the body. Each end cap 24 includes a socketed end portion 34 receiving pressure lines 120 and 122 at the left and right end respectively. The pressure lines 120 and 122 communicate with condensing unit 108 and receive liquid refrigerant from said condensing unit when the solenoids S1 and S2 are energized into the open position. The end caps 24 also include nipples 36 which provide restricted apertures 38 communicating between lines 120 and 122 and associated piston chambers 30. A bleed line 124 interconnects inlet 14 and line 120, and a bleed line 126 interconnects inlet 16 and line 122.

Each piston chamber 30 includes a reduced diameter outer portion, defined by an associated cap passage 26, and an enlarged inner portion 32 extending substantially between margins 28 and valve seats 22.

A piston assembly, generally indicated by numeral 40, is movably mounted within body 12 to control flow between the inlet fittings 14 and 16 and the outlet fitting 18, depending on the location of the piston assembly 40 resulting from the pressure differential existing in lines 120 and 122.

The piston assembly 40 includes opposed pistons 41 and 42 which are interconnected by a push rod 44. Each piston head 41 and 42 includes an outer portion 46 and a inner portion 48 interconnected by a threaded member 50. The inner portion 48 includes an end flange 52 and an inner washer seal 54, constituting a first sealing means, is held against the end of the rear portion 48 by a flanged portion 56 of the threaded member 50. When a piston is in its inner position, for example piston 41 as shown in FIG. 1, the inner seal 54 is engageable in sealing relation with associated annular valve seat 22. When a piston is in its outer position, for example piston 42 as shown in FIG. 1, flange 52 is engageable with the annular margin 28 at the end of associated end cap, said margin constituting a stop means. A cup seal 58, constituting a second sealing means, is attached to each piston outer portion 46 by an end member 49 connected to the piston by a threaded bolt 50, said bolt constituting a connecting means. The seal 58 is sized to be received in sliding relation within an associated piston-receiving cap passage 26.

The push rod 44 interconnecting the piston heads 42 is received in sliding relation within passages 60 provided within each threaded bolt 50. The end of each passage 60 is engageable by an associated end 62 of the push rod 44 which determines the minimum overall length of the piston assembly 40 to prevent both inlet ports being closed at the same time. The push rod 44 carries an intermediate sleeve 64 and a pair of opposed springs 66, constituting biasing means, tending to urge the pistons 41 and 42 away from each other.

The pistons 41 and 42 travel between the limits defined by the annular seats 52 and the stop means provided by the cap annular end margins 28. This travel essentially covers the inlet port of the fittings 14 and 16 communicating with the piston chamber enlarged inner portion 32. The valve body is provided with an internal recess defining the piston chamber inner portions 32 and having a diameter greater than the diameter of the inner seal 54. Because of this structural relationship of parts the seals 54 do not slide across the ports of the fittings 14 and 16 and seal damage is avoided.

The push rod 44 is of a relatively small diameter and, because of this, does not substantially hinder flow of refrigerant between the inlet fittings 14 and 16 and the outlet fitting 18. The push rod 44 is of a length that prevents both inlet ports being closed at the same time. In addition, the rod 44 provides guide means for the pistons 41 and 42 within the piston-receiving passages 26, thereby reducing wear of the piston and cup seals 56. The springs 66 are under compression when the pistons 42 are closest together with the ends of the push rod engaging the ends of the piston passages 60. The springs 66 overcome the frictional force of the cup seals 56 and provide that both inlet ports are open when solenoids S1 and S2 are closed and the system is not running.

The piston assembly 40 is moved to the right, when solenoid S2 is open and solenoid S1 is closed, as a result of the pressure from the liquid refrigerant entering the piston chamber 30 adjacent line 120. The piston assembly 40 moves to the left when solenoid S1 is open as a result of pressure from liquid refrigerant entering the piston chamber 30 adjacent line 122. The restrictions provided by the end cap nipples 36 prevent a sudden rush of pressure and avoid bouncing the pistons against the valve seats 22 thereby prolonging the life of the valve seats. The bleed lines 124 and 126 relieve pressure in lines 120 and 122 respectively when solenoids S1 and S2 are closed permitting both piston 41 and 42 to move to their outer position in which the piston 42 is in the position shown in FIG. 1 and the piston 41 is in the position shown in phantom outline in FIG. 1.

It is thought that the structural relationship of parts and the functional advantages of this shuttle valve have become fully apparent from the foregoing description of parts but for completeness of disclosure the operation of the valve will be briefly described.

When the shuttle valve 10 is intended to operate with both evaporators 104 and 106 active, solenoids S1 and S2 are both closed. In this condition there is no differential pressure between lines 120 and 122. The piston 42 remains in position as shown in FIG. 1 and piston 41 moves to the left, away from the associated seat 22, by virtue of refrigerant pressure in the intermediate chamber assisted by compression springs 66. This allows refrigerant to pass from the high pressure side through both evaporators 104 and 106 to the suction side of the compressor 102. The annular rim 28 provided by the caps 24 provides a stop limiting outward movement of piston 41.

When the shuttle valve 10 is intended to operate with only evaporator 104 active, solenoid valve S1 is energized into the open position, solenoid S2 remaining closed. This results in a differential refrigerant pressure in line 122 which moves the entire piston assembly 40 to the left until the seal 54 of piston 42 engages its annular seat 22 thereby closing inlet 16 from outlet 18. At the same time, because of the push rod connection between the pistons 41 and 42, piston 41 moves to the left causing the seal 54 to move away from its annual seat 22 to the position shown in phantom outline thereby opening inlet 14 to outlet 18. This allows refrigerant to pass from the high pressure side in evaporator 104, through the shuttle valve 10, to the suction side of the compressor 102. The annular rim 28 provided by associated cap 24 provides a stop limiting further movement of piston 41 to the left.

When the shuttle valve 10 is intended to operate with only evaporator 106 active solenoid S2 is energized into the open position and solenoid S1 is de-energized into the closed position. This results in a differential pressure in line 120 which moves the entire piston assembly 40 to the right until the seal 54 of piston 42 engages its annular seat as shown in FIG. 1 thereby closing inlet 14 from outlet 18. The bleed line 126 allows refrigerant trapped in associated piston chamber 30 to vent to the low side of the system to permit the piston 42 to move to the outer position shown in FIG. 1. This allows refrigerant to pass from the high pressure side in the evaporator 106 through the shuttle valve 10 to the suction side of the compressor 102.

The length of the push rod 44 is sized to prevent both pistons 40 from closing at the same time. Thus, when the piston assembly 40 is moved one direction, the push rod connection forces the piston on the opposite seat to open before the pressurized piston seat can close.

The shuttle valve 10 can be used in systems other than that described above. For example, the valve is suitable for use in an energy storage apparatus such as disclosed in U.S. Pat. No. 4,916,916 ad U.S. Pat. No. 4,735,064 which are incorporated herein by reference.

Also, although the improved shuttle valve has been described by making particular reference to a preferred shuttle valve, the details of description are not to be understood as restrictive, numerous variants being possible within the principles disclosed and within the fair scope of the claims hereunto appended.

We claim as our invention:

1. A shuttle valve for use in a dual refrigeration system and operated by controlled refrigerant pressure lines in the system, the valve comprising:

(a) a valve body including piston chambers at each end having an outer portion communicating with an associated controlled pressure line and an enlarged inner portion, and an intermediate chamber disposed between said piston chambers and having valve seats at each end, and said valve body further including at least two inlet ports each communicating with an associated piston chamber inner portion and an outlet port communicating with said intermediate chamber, (b) a piston assembly including opposed pistons each mounted in an associated piston chamber for selectively closing an associated inlet port, in response to differential pressure in the pressure lines each piston having an outer portion received in sliding relation within said piston chamber outer portion and an inner portion, said inner portion including first sealing means received within an associated valve seat and movable within said piston chamber enlarged inner portion and said outer portion including second sealing means engageable with an associated piston chamber outer portion, and (c) means tending to urge said pistons away from each other.

2. A shuttle valve as defined in claim 1, in which:

(d) each piston includes a passage having a closed end and the piston assembly further includes a push rod having opposed ends each received in sliding relation within an associated piston passage.

3. A shuttle valve as defined in claim 2, in which:

(e) said means tending to urge said pistons away from each other include compression spring means operatively mounted on said push rod.

4. A shuttle valve as defined in claim 1, in which:

(d) opposed end caps are threadedly connected to each end of said body portion, each end cap defining a piston chamber outer portion, and including a restricted orifice communicating with said associated pressure lines.

5. A shuttle valve as defined in claim 1, in which:

(d) each piston includes connecting means operatively threadedly connecting said piston outer and inner portions together.

6. A shuttle valve as defined in claim 5, in which:

(e) the first sealing means is a washer seal connected to said inner portion of said piston by said connecting means.

7. A shuttle valve as defined in claim 6, in which:

(f) the second sealing means is a cup seal connected between said inner and outer portions of said piston by said connecting means.

8. A shuttle valve as defined in claim 2, in which:

(e) each piston includes connecting means operatively threadedly connecting said inner and outer portions together, (f) said connecting means includes an axial bolt having a passage receiving an associated end of said push rod therewithin, and (g) said means tending to urge said pistons away from each other include compression spring means operatively mounted on said push rod.

9. A shuttle valve as defined in claim 1, in which:

(d) opposed end caps are threadedly connected to each end of said body, each end cap defining a piston chamber outer portion having an end margin, and (e) each piston inner portion includes a flange engageable with an associated end cap end margin, said engagement limiting outward movement of said associated piston.

10. A shuttle valve as defined in claim 1, in which:

(d) the inlet is connected to its associated pressure line by a bleed line.

* * * * *